US010046337B2

(12) United States Patent
Whitehead

(10) Patent No.: US 10,046,337 B2
(45) Date of Patent: Aug. 14, 2018

(54) CLEANING IN PLACE SYSTEM AND A METHOD OF CLEANING A CENTRIFUGAL SEPARATOR

(71) Applicant: ALFA LAVAL CORPORATE AB, Lund (SE)

(72) Inventor: Neil Whitehead, Ingleby Barwick (GB)

(73) Assignee: ALFA LAVAL CORPORATE AB, Lund (SE)

( * ) Notice: Subject to any disclaimer, the term of this patent is extended or adjusted under 35 U.S.C. 154(b) by 316 days.

(21) Appl. No.: 14/375,105

(22) PCT Filed: Feb. 14, 2013

(86) PCT No.: PCT/EP2013/052981
§ 371 (c)(1),
(2) Date: Jul. 28, 2014

(87) PCT Pub. No.: WO2013/120954
PCT Pub. Date: Aug. 22, 2013

(65) Prior Publication Data

US 2015/0018191 A1 Jan. 15, 2015

(30) Foreign Application Priority Data

Feb. 15, 2012 (EP) ..... 12155585

(51) Int. Cl.
*B04B 15/06* (2006.01)

(52) U.S. Cl.
CPC ..... *B04B 15/06* (2013.01)

(58) Field of Classification Search
CPC ..... B04B 15/06
USPC ..... 494/27, 37
See application file for complete search history.

(56) References Cited

U.S. PATENT DOCUMENTS 3,166,503 A * 1/1965 Thylefors ..... B04B 1/08 494/41
3,682,310 A 8/1972 Valdespino
5,104,371 A * 4/1992 Ajnefors ..... B04B 15/06 494/27

(Continued)

FOREIGN PATENT DOCUMENTS

CN 1034496 A 8/1989
JP 9-75783 A 3/1997

(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A cleaning in place system for a centrifugal separator and a method of cleaning a centrifugal separator are disclosed. The centrifugal separator includes a rotor having a separation space, a separator inlet and a first separator outlet. The first separator outlet includes an outlet pump configured to provide a flow of fluid from the first separator outlet. The cleaning in place system further includes a container for cleaning fluid, a cleaning fluid pump for providing cleaning fluid from the container to the separator inlet, such as an eductor. The cleaning in place system is configured to receive a flow of fluid from the first separator outlet and that the cleaning fluid pump is configured to pump cleaning fluid from the container to the separator inlet by means of the received flow of fluid.

18 Claims, 1 Drawing Sheet

(56) References Cited

U.S. PATENT DOCUMENTS

| | | | | | |
|---|---|---|---|---|---|
| 5,398,733 | A * | 3/1995 | Welch | ..... | B67D 1/0021 137/3 |
| 5,603,826 | A * | 2/1997 | Welch | ..... | B08B 9/0323 134/108 |
| 6,976,948 | B1 * | 12/2005 | Hamblad | ..... | B04B 1/08 494/10 |

FOREIGN PATENT DOCUMENTS

| | | | | | |
|---|---|---|---|---|---|
| JP | 2856275 | B2 * | 2/1999 | ..... | B04B 15/06 |
| KR | 1992-0007589 | | 9/1992 | | |
| WO | WO 89/03251 | A1 | 4/1989 | | |
| WO | WO 2004/094066 | A1 | 11/2004 | | |

* cited by examiner

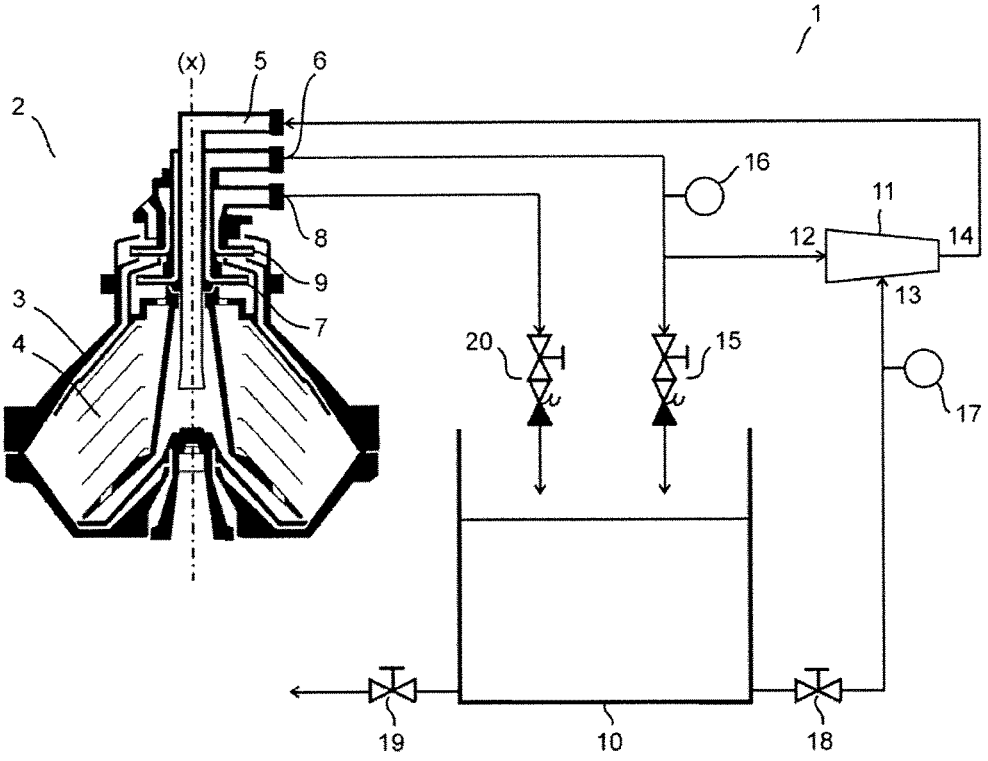
1
(x)
5
6
2
16
11
12
14
8
9
13
3
7
4
20
15
17
19
10
18

CLEANING IN PLACE SYSTEM AND A METHOD OF CLEANING A CENTRIFUGAL SEPARATOR

TECHNICAL FIELD

The invention relates to a cleaning in place system and a method of cleaning a centrifugal separator. The cleaning in place (CIP) system is connectable to a centrifugal separator comprising a rotor arranged for rotation around a rotational axis and forming within itself a separation space. A separator inlet for fluid extends into the separation space and a first separator outlet for fluid extends from the separation space and comprises an outlet pump configured to provide a flow of fluid from the first separator outlet. The CIP system further comprises a container for cleaning fluid and a cleaning fluid pump for providing cleaning fluid from the container to the separator inlet. The invention also relates to a method of cleaning a centrifugal separator by means of a CIP system.

BACKGROUND ART

An example of a known CIP system is disclosed in JP 9075783 A, wherein the system includes a closed container for cleaning liquid. From the container cleaning liquid is pumped towards the inlet of a centrifugal separator by means of supplying compressed air to the closed container from a pressure source. A drawback of this is that the procedure of cleaning is dependent on the availability of such a pressure source.

According to another known example of a CIP system, the system is provided with a separate electric centrifugal pump mounted to the container for pumping cleaning fluid from the container towards the inlet of a centrifugal separator. This has the drawback that the CIP system becomes somewhat heavy and expensive.

SUMMARY

One object of the invention is to reduce the above mentioned shortcomings with known CIP systems. In particular it is sought to obtain a CIP system that is easy to handle, inexpensive and that may be operated independently of external pressure sources when connected to a centrifugal separator.

This object is reached by the subject matter of claim 1, wherein the initially described CIP system has been characterised in that it is configured to receive a flow of fluid from the first separator outlet and that the cleaning fluid pump is configured to pump cleaning fluid from the container to the separator inlet by means of the received flow of fluid. Thus, the CIP system makes use of the flow of fluid from the centrifugal separator outlet pump to drive the pumping of cleaning fluid from the container to the separator inlet. Thereby, when connected to a centrifugal separator the CIP system can be operated independently of any external pressure source and without the need of a separate electric pump. The resulting CIP system may therefore also be less expensive to manufacture and more easy to handle due to a lower weight.

The cleaning fluid pump may comprise an eductor, which may have a motive fluid inlet for receiving fluid from the first separator outlet, a pumping inlet for receiving cleaning fluid to be pumped from the container, and an outlet for motive and pumped fluid. Such an eductor pump, or ejector, is as such known in the art of pumps and uses the Venturi effect of a converging-diverging nozzle to convert pressure energy of the motive fluid to velocity energy which creates a low pressure zone. The low pressure zone draws in fluid from the pumping inlet and the motive fluid flow entrains the pumped fluid, in this case cleaning fluid from the container. After passing a throat of the eductor between the converging and the diverging section, the fluid expands and the velocity is reduced which results in recompressing the fluid by converting velocity energy back into pressure energy. Thereby the pumping of cleaning fluid from the container to the separator inlet may driven by flow of fluid from the centrifugal separator outlet pump and the CIP system may be produced with few moving parts and in a cost-efficient manner.

The CIP system may comprise comprising a valve, in particular a constant pressure valve, arranged to bleed off fluid received from the separator inlet when the pressure exceeds a threshold pressure. Thereby the pressure in the system may be limited to avoid leakage in the separator. The valve may be arranged upstream of the motive fluid inlet of the cleaning fluid pump. The CIP system may be configured to return any fluid bled off by the valve to the container for cleaning fluid.

The outlet pump of the separator may comprise of consist of a paring device, being a stationary device paring off rotating fluid in the rotor. The first separator outlet may extend from a radially inner portion of the separation space for discharge of a light phase of the fluid (light phase outlet) and the separator may be provided with a second separator outlet extending from a radially outer portion of the separation space for discharge of a heavy phase of the product (heavy phase outlet). The CIP system may then comprise a valve arranged to regulate the pressure and/or flow of fluid from the second separator outlet. Alternatively the first separator outlet may be the heavy phase outlet.

Further, a method of cleaning a centrifugal separator is provided, which centrifugal separator comprises a rotor arranged for rotation around a rotational axis and forming within itself a separation space, a separator inlet extending into the separation space for a fluid, a first separator outlet for fluid extending from the separation space, wherein said first separator outlet comprises an outlet pump configured to provide a flow of fluid from the first separator outlet, comprising the steps of;

- connecting a CIP system as described herein to the centrifugal separator,
- rotating the rotor at an operational speed, being the operational speed for the cleaning procedure,
- filling the separation space of the rotor with a fluid, such as water,
- generating a flow of fluid from the separation space through the first separator outlet by means of the outlet pump,
- receiving the flow of fluid from the first separator outlet at the cleaning fluid pump,
- pumping cleaning fluid from the container to the separator inlet by means of the received flow of fluid, preferably by means of an eductor, and
- introducing cleaning fluid into the separation space such as to clean at least parts of the separation space.

Further, the method may comprise the step of

- bleeding off fluid from the first separator outlet when the pressure exceeds a threshold pressure.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawing, in which The FIGURE shows a CIP system according to an embodiment of the invention, connected to a centrifugal separator.

DETAILED DESCRIPTION

With reference to the FIGURE, a cleaning in place (CIP) system 1 is shown, connected to a centrifugal separator 2 (shown in part). The separator comprises a rotor 3 arranged for rotation around a rotational axis (x) and forming within itself a separation space 4. A separator inlet 5 extends into the separation space for supplying a fluid to the separation space. A first separator outlet 6 extends from a radially inner portion of the separation space and comprises an outlet pump 7 in the form of a paring device, configured to provide a flow of fluid from the first separator outlet (light phase outlet). The separator further comprises a second separator outlet 8 extends from a radially outer portion of the separation space and comprises a second outlet pump 9 in the form of a paring device, configured to provide a flow of fluid from the second separator outlet (heavy phase outlet).

The CIP system further comprises a container 10 for cleaning fluid and a cleaning fluid pump comprising an eductor 11. The eductor is provided with a motive fluid inlet 12 for receiving fluid from the first separator outlet, a pumping inlet 13 for receiving cleaning fluid to be pumped from the container, and a pump outlet 14 for motive and pumped fluid. The motive fluid inlet 12 is connected to the first separator outlet 6 and the pump outlet 14 is connected to the separator inlet 5. The pumping inlet 13 is connected to the lower portion of the container 10. Between the first separator outlet and the motive fluid inlet a constant pressure valve 15 is arranged, and any fluid bled off from this valve is arranged to be returned to the container 10. A pressure indicating device 16 is arranged to monitor the pressure at the motive fluid inlet 12. A temperature indicating device 17 is arranged to monitor the temperature of the fluid in the system, and preferably located at the pumping inlet 13. The system is also provided with a first valve 18 for controlling the flow of fluid from the container 10 to the pumping inlet 13, and a second valve 19 for emptying the container. The second outlet is provided with a regulating valve 20 arranged to be able to close this outlet. As an alternative the second outlet is provided with a flow-restrictive element, such as in the form of an orifice, and a shut-off valve.

During operation, the rotor 3 of the centrifugal separator 1 is rotated at an operational speed. The container 10 is filled with a water, or another suitable fluid, and water is also manually introduced in the separation space 4 of the rotor via the inlet 5, until it start to come out of the second outlet 8 (heavy phase outlet). The second separator outlet is then closed by the valve 20. When the fluid in the separation space reaches the first separator outlet 6, a flow of fluid is generated from the first separator outlet by the outlet pump 7. The flow of fluid from the first separator outlet is received at the motive fluid inlet of the eductor. After passing the eductor, the fluid is returned to the separator inlet. When a pressure of about 2 bar has been built up in the system, the motive fluid will start to draw fluid from the container, via the pumping inlet 13 and out through the pump outlet 14. Cleaning fluid (CIP liquid) is then introduced in the container and is pumped by the eductor towards the separator inlet 5. At the separator inlet, the cleaning fluid is introduced into the separation space to clean it. The cleaning fluid is then recirculated to the motive fluid inlet of the eductor by means of the outlet pump of the first separator outlet, and a recirculating flow of cleaning fluid is maintained by the outlet pump of the separator. When the pressure exceeds a threshold of about 3 bar, the constant pressure regulating valve 15 will open and bleed of circulating fluid to the container. The pressure in the recirculating loop may be monitored by the pressure sensing device 16. The valve 20 on the second separator outlet 8 may then be partially opened to enable cleaning of this outlet.

As an alternative to what is disclosed in FIG. 1, the second outlet 8 (heavy phase outlet) may be connected to the motive fluid inlet 12 of the eductor to provide motive fluid for the pumping of cleaning fluid.

The invention claimed is:

1. A centrifugal separator system comprising:

a centrifugal separator, the centrifugal separator comprising:

a rotor arranged for rotation around a rotational axis and forming therein a separation space;

a separator inlet extending into the separation space for a fluid; and a first separator outlet for fluid extending from the separation space;

a container for cleaning fluid;

a cleaning fluid pump for providing cleaning fluid from the container to the separator inlet;

a conduit having a first end connected to the container and a second end connected to an inlet of the cleaning fluid pump;

a first inlet line having a first end attached to an outlet of the cleaning fluid pump and a second end connected to the separator inlet; and a first outlet line extending from the first separator outlet, the first outlet line including a first branch having a first end connected to and supplying fluid to the inlet of the cleaning fluid pump and a second branch extending to and supplying fluid to the container.

2. The centrifugal separator system according to claim 1, further comprising an outlet pump configured to provide a flow of fluid from the first separator outlet.

3. The centrifugal separator system according to claim 1 wherein the first separator outlet extends from a radially inner portion of the separation space for discharge of a light phase of the fluid.

4. The centrifugal separator system according to claim 3, wherein the centrifugal separator further comprises a second separator outlet extending from a radially outer portion of the separation space for discharge of a heavy phase of the fluid.

5. A method of cleaning a centrifugal separator, the centrifugal separator comprising a rotor arranged for rotation around a rotational axis and forming therein a separation space, a separator inlet extending into the separation space for a fluid, and a first separator outlet for fluid extending from the separation space, said first separator outlet comprising an outlet pump configured to provide a flow of fluid from the first separator outlet, said method comprising the steps of:

rotating the rotor at an operational speed;

filling the separation space of the rotor with a fluid;

generating a flow of fluid from the separation space through the first separator outlet by the outlet pump;

providing cleaning fluid in a container;

receiving the flow of fluid at a cleaning fluid pump through a first outlet line extending from the first separator outlet, the first outlet line supplying fluid to a first branch having a first end connected to an inlet of the cleaning fluid pump and supplying fluid to a second branch extending to the container;

pumping the cleaning fluid from the container to the separator inlet through a conduit having a first end connected to the container and a second end connected to the inlet of the cleaning fluid pump and a first inlet line having a first end attached to an outlet of the cleaning fluid pump and a second end connected to the separator inlet by the received flow of fluid; and introducing the cleaning fluid into the separation space to clean at least parts of the separation space.

6. The method of cleaning a centrifugal separator according to claim 5, further comprising the step of bleeding off fluid from the first separator outlet when the pressure exceeds a threshold pressure.

7. The centrifugal separator system according to claim 1, further comprising:

a pressure sensor on the first outlet line; and a valve on the first outlet line to bleed off fluid received from the first separator outlet when pressure exceeds a threshold pressure.

8. The centrifugal separator system according to claim 7, wherein any fluid bled off by the valve is sent to the container for cleaning fluid.

9. The centrifugal separator system according to claim 4, further comprising a valve arranged to regulate the pressure and/or flow of fluid from the second separator outlet.

10. A centrifugal separator system comprising:

a centrifugal separator, the centrifugal separator comprising:

a rotor arranged for rotation around a rotational axis and forming therein a separation space;

a separator inlet extending into the separation space for a fluid;

a first separator outlet for fluid extending from the separation space; and a second separator outlet for discharge of a heavy phase of the fluid;

a container for cleaning fluid;

a cleaning fluid pump for providing cleaning fluid from the container to the separator inlet;

a conduit having a first end connected to the container and a second end connected to an inlet of the cleaning fluid pump;

a first inlet line extending between an outlet of the cleaning fluid pump and the separator inlet;

a first outlet line having a first end connected to the first separator outlet and a second end extending to the container and a branch connected to the cleaning fluid pump;

a second outlet line extending between the second separator outlet and the container;

a first valve on the first outlet line to regulate the pressure and/or flow of fluid from the first separator outlet independent of the second outlet line; and a second valve on the second outlet line to regulate the pressure and/or flow of fluid from the second separator outlet independent of the first outlet line.

11. The centrifugal separator system according to claim 10, wherein the first separator outlet extends from a radially inner portion of the separation space for discharge of a light phase of the fluid.

12. The centrifugal separator system according to claim 11, wherein the second separator outlet extends from a radially outer portion of the separation space.

13. The centrifugal separator system according to claim 10, further comprising an outlet pump at the first separator outlet configured to provide a flow of fluid from the first separator outlet.

14. The centrifugal separator system according to claim 2, wherein the outlet pump comprises a paring device.

15. The centrifugal separator system according to claim 1, wherein the cleaning fluid pump comprises an eductor.

16. The centrifugal separator system according to claim 1, wherein the inlet of the cleaning fluid pump comprises a first inlet for the conduit and a second inlet for the first branch of the first outlet line.

17. The centrifugal separator system according to claim 5, wherein the inlet of the cleaning fluid pump comprises a first inlet for the conduit and a second inlet for the first branch of the first outlet line.

18. The centrifugal separator system according to claim 10, wherein the inlet of the cleaning fluid pump comprises a first inlet for the conduit and a second inlet for the branch of the first outlet line.

* * * * *